US009421767B2

(12) United States Patent
Naganuma et al.

(10) Patent No.: US 9,421,767 B2
(45) Date of Patent: Aug. 23, 2016

(54) LIQUID EJECTING HEAD AND MANUFACTURING METHOD OF LIQUID EJECTING HEAD

(71) Applicant: SEIKO EPSON CORPORATION, Tokyo (JP)

(72) Inventors: Yoichi Naganuma, Matsumoto (JP); Eiju Hirai, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/743,386

(22) Filed: Jun. 18, 2015

(65) Prior Publication Data

US 2015/0367644 A1 Dec. 24, 2015

(30) Foreign Application Priority Data

Jun. 18, 2014 (JP) ..... 2014-125059

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/14201* (2013.01); *B41J 2/1621* (2013.01); *B41J 2002/14306* (2013.01); *B41J 2002/14419* (2013.01); *Y10T 29/49403* (2015.01)

(58) Field of Classification Search
CPC ..... B41J 2/14201; B41J 2002/14225; B41J 2/14233; B41J 2002/14241; B41J 2/14274; B41J 2002/14306
See application file for complete search history.

(56) References Cited

U.S. PATENT DOCUMENTS 4,514,742 A * 4/1985 Suga ..... B41J 2/17596 137/513.7
5,742,312 A * 4/1998 Carlotta ..... B41J 2/17556 347/87
2014/0043401 A1 2/2014 Torimoto et al.

FOREIGN PATENT DOCUMENTS

JP 2014-34114 A 2/2014

* cited by examiner

*Primary Examiner* — Geoffrey Mruk
(74) *Attorney, Agent, or Firm* — Workman Nydegger

(57) ABSTRACT

A liquid ejecting head includes a nozzle which ejects a liquid, a pressure chamber, a portion of which is partitioned by a flexible diaphragm and which communicates with the nozzle, a piezoelectric element which is laminated on an opposite side of the diaphragm from the pressure chamber and changes a pressure within the pressure chamber, and a reservoir which communicates with the pressure chamber, in which a valve mechanism is provided in a region which is distanced from a region in which the piezoelectric element of the diaphragm is laminated, and is configured to allow the liquid to flow from the reservoir side into the pressure chamber side while inhibiting the liquid from flowing out from the pressure chamber side to the reservoir side.

5 Claims, 14 Drawing Sheets

LIQUID EJECTING HEAD AND MANUFACTURING METHOD OF LIQUID EJECTING HEAD

CROSS-REFERENCE TO RELATED APPLICATIONS

The entire disclosure of Japanese Patent Application No: 2014-125059, filed Jun. 18, 2014 is expressly incorporated by reference herein in its entirety.

BACKGROUND

1. Technical Field

The present invention relates to a liquid ejecting head which ejects a liquid within a pressure chamber from a nozzle which communicates with the pressure chamber, and a manufacturing method of the liquid ejecting head.

2. Related Art

A liquid ejecting apparatus is an apparatus which is provided with a liquid ejecting head and which ejects various liquids from an ejecting head. An image recording apparatus such as an ink jet printer or an ink jet plotter is an example of the liquid ejecting apparatus; however, recently liquid ejecting apparatuses are also being adapted for use in various manufacturing apparatuses, making use of the characteristic of being capable of causing minute amounts of a liquid to accurately land on predetermined positions. For example, the liquid ejecting apparatuses are being adapted for use in display manufacturing apparatuses which manufacture color filters of liquid crystal displays and the like, electrode forming apparatuses which form electrodes of organic electro-luminescence (EL) displays, face emission displays (FED), and the like, and chip manufacturing apparatuses which manufacture biochips (biochemical elements). In a recording head for an image recording apparatus, a liquid-state ink is ejected, and in a color material ejecting head for a display manufacturing apparatus, solutions of color materials for each of red (R), green (G), and blue (B) are ejected. In an electrode material ejecting head for an electrode forming apparatus, a liquid-state electrode material is ejected, and in a bio-organic matter ejecting head for a chip manufacturing apparatus, a solution of bio-organic matter is ejected.

A plurality of nozzles, pressure chambers, one of which is formed for each nozzle, and a reservoir which is shared by the plurality of pressure chambers (also referred to as a common liquid chamber or a manifold) are provided inside the liquid ejecting head described above. Supply paths, which are formed to be narrower than the pressure chambers and which serve as channel resistance in relation to the liquid which flows into the pressure chambers, are formed in locations which communicate the reservoir with each of the pressure chambers (for example, refer to JP-A-2014-034114). The liquid ejecting head is configured to generate pressure fluctuation (a pressure change) in the liquid within the pressure chambers by the driving of piezoelectric elements (actuators), and to eject the liquid from the nozzles using the pressure fluctuation.

However, in the liquid ejecting head described above, when the pressure fluctuation is generated in the liquid within the pressure chambers, there is a counterflow of a portion of the liquid from the pressure chamber side to the reservoir side through the supply path. Due to the counterflow of a portion of the liquid, it may not be possible to eject the liquid from the nozzles by efficiently using the pressure fluctuation caused by the piezoelectric elements.

SUMMARY

An advantage of some aspects of the invention is to provide a liquid ejecting head capable of efficiently ejecting a liquid, and a manufacturing method of the liquid ejecting head.

According to an aspect of the invention, a liquid ejecting head includes a nozzle which ejects a liquid a pressure chamber, a portion of which is partitioned by a flexible diaphragm and which communicates with the nozzle, an actuator which is laminated on an opposite side of the diaphragm from the pressure chamber and changes a pressure within the pressure chamber, and a reservoir which communicates with the pressure chamber, in which a valve mechanism is provided in a region which is distanced from a region in which the actuator of the diaphragm is laminated, and is configured to allow the liquid to flow from the reservoir side into the pressure chamber side while inhibiting the liquid from flowing out from the pressure chamber side to the reservoir side.

In this case, it is possible to efficiently transmit the pressure change within the pressure chamber to the nozzle side when the liquid is ejected from the nozzle. As a result, it is possible to efficiently eject the liquid from the nozzle.

In the above configuration, it is preferable that the valve mechanism includes an opening which communicates the reservoir with the pressure chamber, and a valve receiving body which is provided in a position to mutually face the opening in the reservoir side, and it is preferable that, when an internal pressure of the pressure chamber rises relatively, an edge of the opening is elastically displaced to the reservoir side and inhibits the liquid from flowing out.

In this case, it is possible to simplify the configuration of the valve mechanism.

In this case, it is preferable that the edge of the opening and the valve receiving body overlap each other as viewed from a center axial direction of the opening of the diaphragm.

In this case, it is possible to more reliably prevent the flowing out of the liquid to the reservoir side.

In the configurations described above, it is preferable that at least a portion of the reservoir is partitioned by a portion which functions as a damper which absorbs a pressure change of the liquid within the reservoir.

In this case, it is possible to absorb the pressure change which occurs when the liquid is supplied into the reservoir.

According to another aspect of the invention, in a manufacturing method of a liquid ejecting head which includes a nozzle which ejects a liquid, a pressure chamber, a portion of which is partitioned by a flexible diaphragm and which communicates with the nozzle, an actuator which is laminated on an opposite side of the diaphragm from the pressure chamber and changes a pressure within the pressure chamber, a reservoir which communicates with the pressure chamber, and a valve mechanism which is provided in a region which is distanced from a region in which the actuator of the diaphragm is laminated, the method includes forming an opening in a region which is distanced from a region of the diaphragm in which the actuator is laminated, forming a valve receiving body in a region which overlaps the opening of the diaphragm in the reservoir side to interpose a thin film therebetween, and removing at least the thin film between the opening and the valve receiving body.

In this case, it is possible to easily form the valve mechanism.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, description will be given of the embodiments of the invention with reference to the attached drawings. Note that, in the embodiments described hereinafter, there are various limits as favorable embodiments of the invention; however, the scope of the invention is not limited thereto as long as there is no wording particularly limiting the invention in the description hereinafter. Hereinafter, an ink jet printer (hereinafter, a printer) with an ink jet recording head (hereinafter, a recording head), which is a type of the liquid ejecting head, mounted thereon will be described as an example of the liquid ejecting apparatus of the invention.

Figure 1:
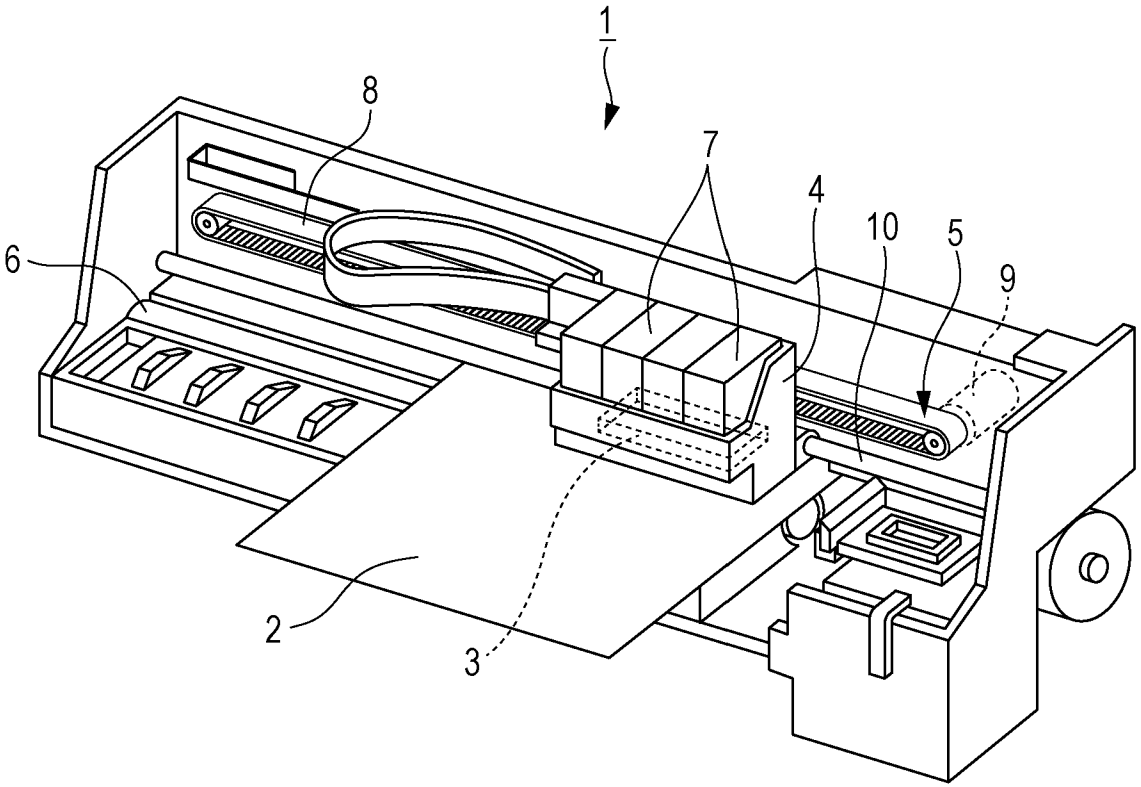
FIG. 1 is a perspective diagram illustrating the configuration of a printer.

Description will be given of the configuration of a printer 1 with reference to FIG. 1. The printer 1 is an apparatus which performs recording of an image or the like by ejecting a liquid-state ink onto the surface of a recording medium 2 (a type of landing target) such as recording paper. The printer 1 is provided with a recording head 3, a carriage 4, a carriage moving mechanism 5, a transport mechanism 6, and the like. The recording head 3 is attached to the carriage 4, the carriage moving mechanism 5 causes the carriage 4 to move in a main scanning direction, and the transport mechanism 6 conveys the recording medium 2 in a sub-scanning direction. Here, the ink is a type of the liquid in the invention, and is stored in ink cartridges 7 which serve as liquid storage sources (liquid supply sources). The ink cartridges 7 are detachably mounted to the recording head 3. Note that, a configuration may be adopted in which ink cartridges are disposed on a main body side of a printer, and an ink is supplied from the ink cartridges to a recording head through ink supply tubes.

The carriage moving mechanism 5 described above is provided with a timing belt 8. The timing belt 8 is driven by a pulse motor 9 such as a DC motor. Accordingly, when the pulse motor 9 operates, the carriage 4 is guided by a guide rod 10 which is provided to span across the printer 1, and moves reciprocally in the main scanning direction (the width direction of the recording medium 2).

Figure 2A:
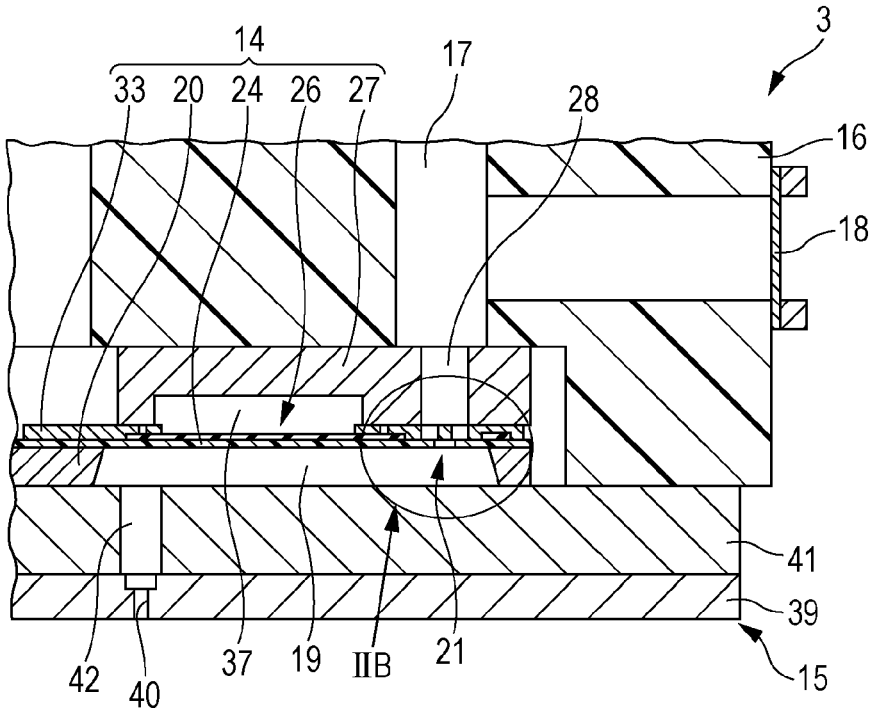
FIG. 2A is a cross sectional diagram illustrating the configuration of a recording head.
Figure 2B:
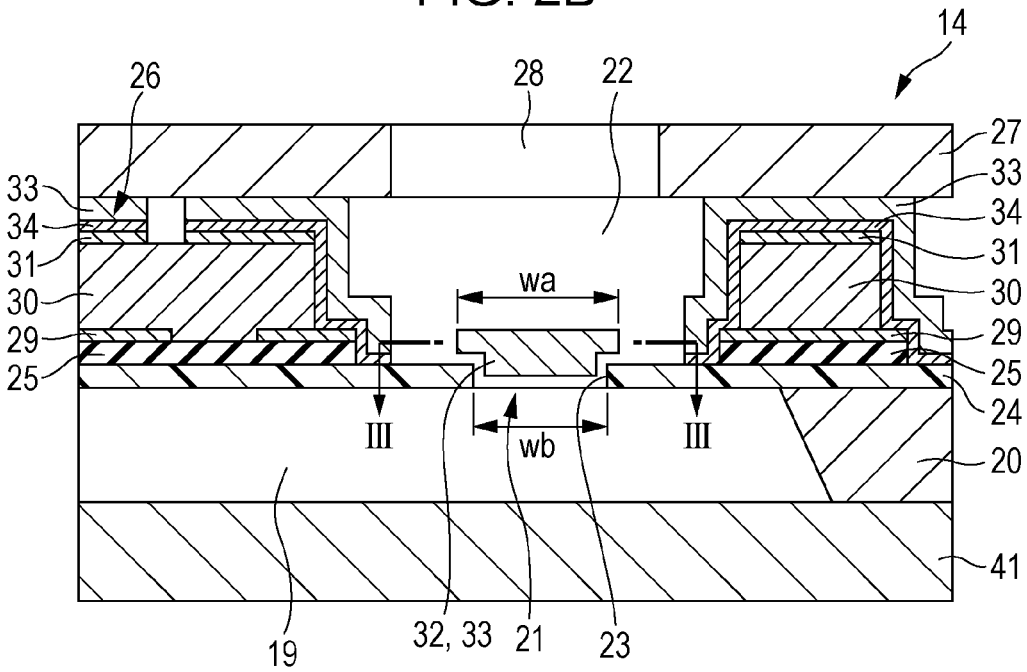
FIG. 2B is an enlarged diagram illustrating region IIB.
Figure 3:
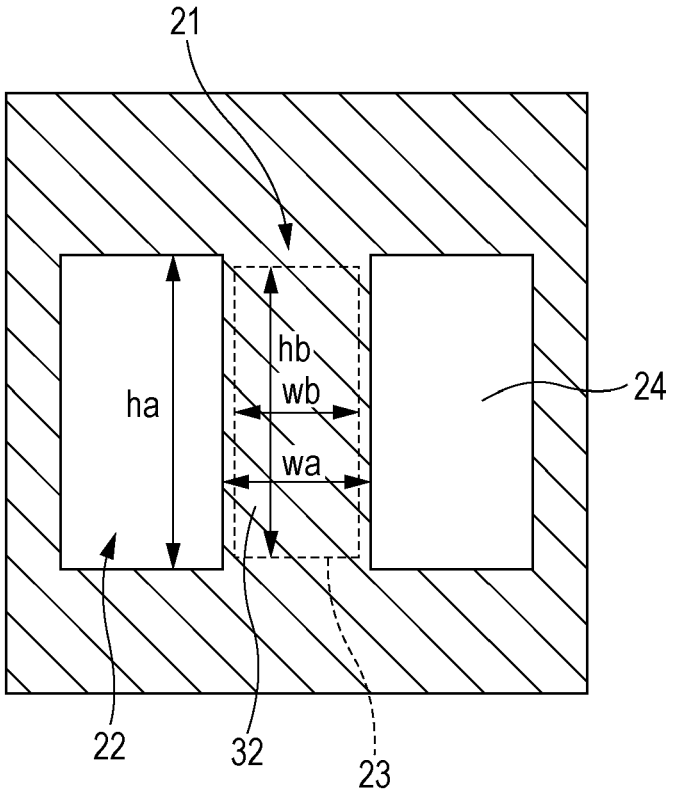
FIG. 3 is a cross sectional diagram taken along line III-III in FIG. 2B.

FIG. 2A is a cross sectional diagram illustrating the configuration of the recording head 3, and FIG. 2B is an enlarged diagram illustrating region IIB in FIG. 2A. FIG. 3 is a cross sectional diagram taken along line III-III in FIG. 2B. Note that, in FIGS. 2A and 2B, the configuration of the main portions corresponding to another nozzle row is omitted due to being laterally symmetrical with the depicted configuration. As illustrated in FIG. 2A, the recording head 3 in the present embodiment is provided with a pressure generation unit 14 and a channel unit 15, and is configured to be attached to a head case 16 in a state in which the members are laminated together.

The head case 16 is a box-shaped member formed of a synthetic resin, and a reservoir 17 (also referred to as a common liquid chamber or a manifold) which supplies the ink to a plurality of pressure chambers 19 is formed inside the head case 16. The ink which flows from the ink cartridges 7 into the recording head 3 is stored in the reservoir 17. The reservoir 17 of the present embodiment is formed in the head case 16 with the bottom of the reservoir 17 in an open state, and is partitioned by the inner wall surfaces of the head case 16 and the top surface of a protective substrate (described later). The reservoir 17 is partitioned by a portion (a compliance portion) which functions as a damper which absorbs a pressure change of the ink within the reservoir 17. In the present embodiment, the compliance portion is formed by an opening portion of the reservoir 17 to the side surfaces of the head case 16, and sealing the opening with a flexible compliance sheet 18. Note that, the compliance sheet 18 is formed of a hard substrate and film material laminated thereon, and is joined to the head case 16 from the film material side. A portion of the compliance sheet 18 which is formed by removing a portion of the substrate and leaving only the film material forms the compliance portion. Using the compliance portion, it is possible to absorb changes in pressure which occur when the ink is supplied into the reservoir 17.

The pressure generation unit 14 forms a unit by a pressure chamber forming substrate 20 which forms the pressure chamber 19, a diaphragm 24, a piezoelectric element 26 (a type of actuator (pressure generating unit)), the protective substrate 27, and the like being laminated together. The pressure chamber forming substrate 20 is formed of a silicon single crystal substrate, for example, and the plurality of pressure chambers 19 are formed to correspond to each nozzle 40 of a nozzle plate 39. In the present embodiment, two rows of the nozzles 40 are formed on the nozzle plate 39, and thus, there are two rows of the pressure chambers 19 corresponding to the respective nozzle rows formed on the pressure chamber forming substrate 20. The pressure chamber 19 is a hollow portion which is long in the direction perpendicular to the direction in which the nozzles 40 are lined up, and extend from a position corresponding to the nozzle 40 to a position corresponding to the reservoir 17 at substantially the same width.

The diaphragm 24 (a type of flexible elastic film) is formed on the top surface of the pressure chamber forming substrate 20 (the surface of the opposite side from the joining surface with a communication substrate 41) in a state in which the diaphragm 24 seals the opening in the top portion of the pressure chamber 19. In other words, the top surface of the pressure chamber 19 is partitioned by the diaphragm 24. For example, the diaphragm 24 is formed of silicon dioxide which is approximately 1 μm thick. As illustrated in FIG. 2B, a plurality of openings 23 which penetrate the diaphragm 24 in the plate thickness direction thereof are formed in the end portion of the reservoir 17 side of the diaphragm 24 to correspond to each of the pressure chambers 19. The opening 23 is a portion which forms a valve mechanism 21, and detailed description will be given later. An insulating film 25 formed of zirconium oxide, for example, is formed in a region on top of the diaphragm 24 and distanced from the valve mechanism 21. Specifically, as illustrated in FIG. 2B, the insulating film 25 is formed in a region in which the piezoelectric element 26 is laminated and in the periphery of a valve space 22 in which the valve mechanism 21 is formed so as to avoid the valve mechanism 21. The piezoelectric elements 26 are formed in positions corresponding to each of the pressure chambers 19 on the insulating film 25.

The piezoelectric element 26 of the present embodiment is a so-called flexure mode piezoelectric element 26. As illustrated in FIG. 2B, the piezoelectric element 26 is formed by the sequential lamination of a bottom electrode film 29, a piezoelectric layer 30, and a top electrode film 31 on the insulating film 25 of the nozzle 40 side. In the present embodiment, whereas the bottom electrode film 29 is provided independently for each of the pressure chambers 19, the top electrode film 31 is provided continually across the plurality of pressure chambers 19. Therefore, the bottom electrode films 29 are individual electrodes for each of the pressure chambers 19, and the top electrode film 31 is a common electrode which is shared by the pressure chambers 19. The region in which the piezoelectric layer 30 is interposed between the bottom electrode film 29 and the top electrode film 31 is an active portion in which piezoelectric deformation occurs due to the application of a voltage between both electrodes. Note that, the bottom electrode film may be provided as a common electrode by forming the bottom electrode film continually across the plurality of pressure chambers, and the top electrode film may be provided as individual electrodes by providing the top electrode film independently for each of the pressure chambers. Various metals such as indium (Ir), platinum (Pt), titanium (Ti), tungsten (W), tantalum (Ta), and molybdenum (Mo), an alloy thereof, or the like may be used as the top electrode film 31 and the bottom electrode film 29. $LaNiO_3$ is an example of an alloy electrode. A ferroelectric material such as lead zirconate titanate (PZT), a relaxor ferroelectric body obtained by adding a metal such as niobium, nickel, magnesium, bismuth or yttrium to the ferroelectric material, or the like may be used as the piezoelectric layer 30. It is also possible to use a lead free material such as barium titanate as the piezoelectric layer 30.

The bottom electrode film 29, the piezoelectric layer 30, and the top electrode film 31 are formed to surround the valve mechanism 21, even in the periphery of the valve mechanism 21. Accordingly, the valve space 22 is formed in the periphery of the valve mechanism 21 by partitioning. Since a plurality of the valve mechanisms 21 are formed to correspond to the plurality of pressure chambers 19, a plurality of the valve spaces 22 are also formed to correspond thereto. Specifically, as illustrated in FIG. 2B, the top electrode film 31 and the bottom electrode film 29, which are electrically isolated from the top electrode film 31 and the bottom electrode film 29 of the piezoelectric element 26, are formed in a position shifted closer to the valve mechanism 21 side than the piezoelectric element 26 to interpose the piezoelectric layer 30 which extends from the piezoelectric element 26. The bottom electrode film 29, the piezoelectric layer 30, and the top electrode film 31 are also laminated on the opposite side from the piezoelectric element to interpose the valve mechanism 21, and on both sides of the valve mechanism 21 in the nozzle row direction. Accordingly, the valve space 22 is formed in the periphery of the valve mechanism 21. Note that, a voltage is not applied to the top electrode film 31 and the bottom electrode film 29 of the portions which partition the periphery of the valve space 22. Therefore, the piezoelectric layer 30 interposed therebetween will not warp through intentional deformation.

As illustrated in FIG. 2A, a common metal layer 33 which continues across the plurality of pressure chambers 19 is laminated in an end portion region of the piezoelectric element 26 in the longitudinal direction (the direction perpendicular to the nozzle row direction). The common metal layer 33 is formed of gold (Au), for example, and, as illustrated in FIG. 2B, and is laminated on top of the top electrode film 31 via an adhesion layer 34 (a thin film in the invention) which is formed of titanium, nickel, chrome, an alloy thereof, or the like. The common metal layer 33 and the adhesion layer 34 of the present embodiment are formed on both end portions of the piezoelectric element 26 in the longitudinal direction, and in the periphery of the valve space 22. The common metal layer 33 which is formed on the end portion of the nozzle 40 side of the piezoelectric element 26 is electrically connected to the top electrode film 31 and the bottom electrode film 29, and, as illustrated in FIG. 2A, extends past the end portion of the pressure chamber 19 (in detail, the top opening edge of the space which forms the pressure chamber) to a terminal region. The common metal layer 33 is electrically connected to electrode terminals of a wiring member (not shown) such as a flexible cable in the terminal region. Only the common metal layer 33 is partially formed in a position relative to the opening 23 of the diaphragm 24 within the valve space 22. The portion of the common metal layer 33 is the portion which serves as a valve receiving body 32 of the valve mechanism 21. Detailed description of the valve receiving body 32 will be given later.

The protective substrate 27 is disposed on top of the common metal layer 33. Specifically, layers of the diaphragm 24, the insulating film 25, the bottom electrode film 29, the piezoelectric layer 30, the top electrode film 31, the adhesion layer 34, and the common metal layer 33 are laminated on the pressure chamber forming substrate 20, and the bottom surface (the surface of the common metal layer 33 side) of the protective substrate 27 at which the plate thickness is the greatest is joined to the top of the common metal layer 33. Note that, the protective substrate 27 is made of, for example, glass, ceramic material, silicon single crystal substrate, metal, or a hard member of synthetic resin or the like. A concave portion 37, which is formed at a size at which the driving of the piezoelectric element 26 is not inhibited, is formed in a region of the protective substrate 27 facing the active portion of the piezoelectric element 26. In the protective substrate 27, a plurality of communication paths 28, which penetrate the protective substrate 27 in the plate thickness direction, are formed to correspond to the plurality of lined up pressure chambers 19 in positions corresponding to the valve spaces 22. The top end of the communication path 28 communicates with the reservoir 17, and the bottom end of the communication path 28 communicates with the pressure chamber 19 via the valve mechanism 21. Unlike the supply path of the related art which communicates between the reservoir and the pressure chamber, the communication path 28 is configured to reduce the channel resistance as much as possible. In other words, the supply path of the related art is designed to have a predetermined channel resistance by being formed with a narrower width than the pressure chamber; however, in the recording head 3 of the present embodiment, since the communication path 28 includes the valve mechanism 21, it is not necessary to provide the channel resistance, and the communication path 28 is formed such that, for example, the cross-sectional area of the communication path 28 is greater than or equal to the cross-sectional area of the pressure chamber 19. Note that, with regard to the communication path 28, it is also possible to configure the communication path 28 as a channel which is shared by the pressure chambers as a portion of the reservoir without partitioning the communication path 28 for each pressure chamber.

The channel unit 15 includes the communication substrate 41 which is joined to the bottom surface of the pressure chamber forming substrate 20 and the nozzle plate 39 which is joined to the bottom surface of the communication substrate 41. A plurality of the nozzles 40 are open in the nozzle plate 39 in a straight line formation (row formation). The plurality of lined up nozzles 40 are provided at an equal interval along the sub-scanning direction which is perpendicular to the main scanning direction from the nozzle 40 of one end side to the nozzle 40 of the other end side at a pitch (for example, 180 dpi) corresponding to the dot formation density. In the present embodiment, two nozzle rows are formed on the nozzle plate 39. The communication substrate 41 partitions the bottom surface of the pressure chamber 19 by sealing the bottom opening of the pressure chamber 19. Nozzle communication paths 42 which communicate between the nozzles 40 and the pressure chambers 19 are provided in the communication substrate 41 to line up in a straight line formation at the same pitch as the nozzles 40. Note that, the nozzle 40 and the nozzle communication path 42 are formed on the end portion of the opposite side from the valve mechanism 21 side of the pressure chamber 19 in the longitudinal direction of the pressure chamber 19. The head case 16 is joined to the top surface of the communication substrate 41 closer to the outside than the pressure generation unit 14 in a state of housing the pressure generation unit 14 therein.

Next, description will be given of the valve mechanism 21. As described above, the valve mechanism 21 is provided in a region which is distanced from the region in which the piezoelectric element 26 of the diaphragm 24 is laminated, and is configured to allow the ink to flow from the reservoir 17 side into the pressure chamber 19 side while inhibiting the ink from flowing out from the pressure chamber 19 side to the reservoir 17 side. Specifically, as illustrated in FIG. 2B, the valve mechanism 21 includes an opening 23 and a valve receiving body 32. The opening 23 is formed in the diaphragm 24 in the valve space 22 and communicates the reservoir 17 with the pressure chamber 19 via the communication path 28 and the valve space 22, and the valve receiving body 32 is provided in a position to face the opening 23 mutually in the reservoir 17 side and is formed of a portion of the common metal layer 33. As described above, since the diaphragm 24 is flexible, the edge of the opening 23 of the diaphragm 24 functions as a valve body which is displaced according to variation in the internal pressure of the pressure chamber 19. As illustrated in FIG. 3, the valve receiving body 32 of the present embodiment is formed in the shape of a bridge which extends in the nozzle row direction in the center of the valve space 22 and functions as a valve seat in relation to the edge of the opening 23. The opening 23 of the diaphragm 24 is formed to be a size smaller than the valve receiving body 32. In other words, in plan view (as viewed from a center axial direction of the opening 23 of the diaphragm 24), the edge of the opening 23 of the diaphragm 24 and the valve receiving body 32 are formed so as to overlap each other. As illustrated in FIG. 2B, the portion of the valve receiving body 32 which overlaps the diaphragm 24, that is, the edge of the valve receiving body 32 is depressed to the reservoir 17 side by the thickness of the diaphragm 24, and is distanced from the diaphragm 24 by leaving a gap equal to the thickness of the adhesion layer 34 in a state in which the diaphragm 24 is not displaced (a non-flexing state).

Figure 4A:
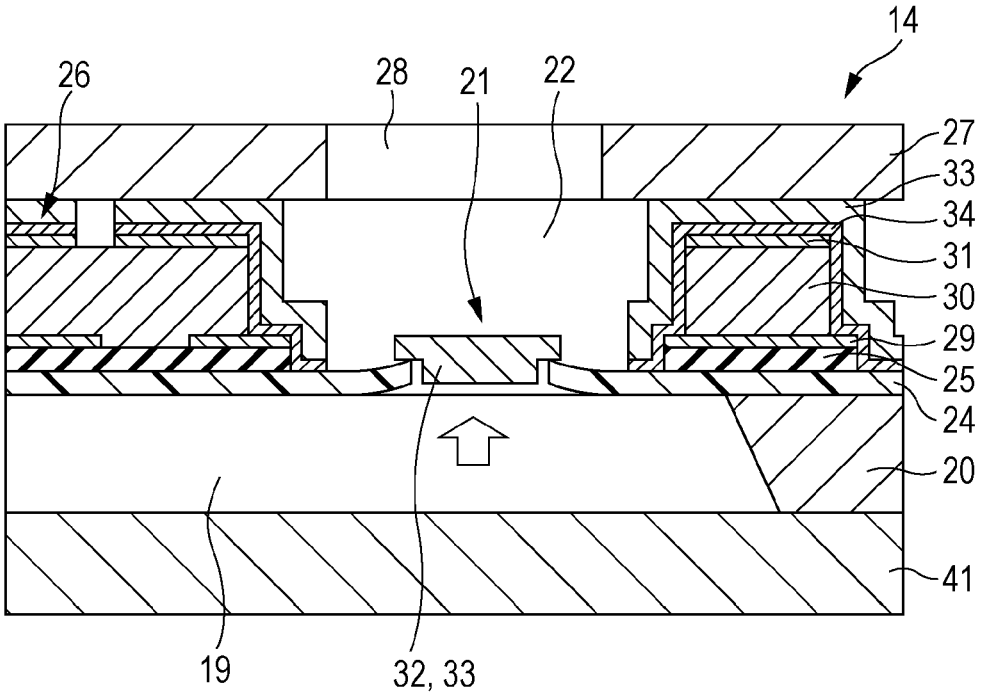
FIGS. 4A and 4B are schematic diagrams illustrating the operations of a valve mechanism.
Figure 4B:
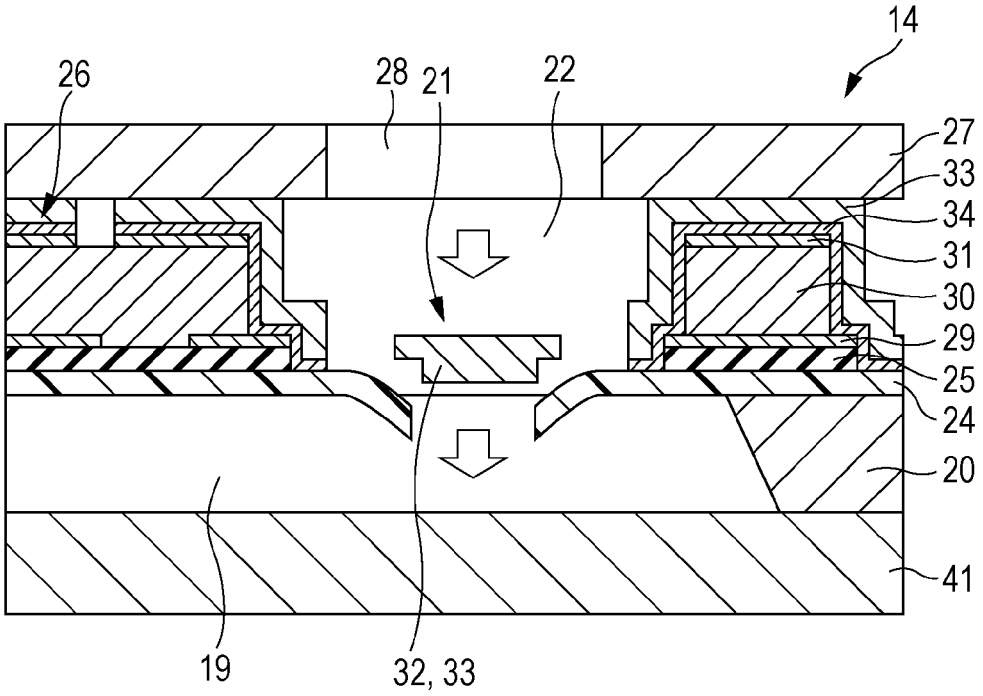

In the valve mechanism 21 which is formed in this manner, when the internal pressure of the pressure chamber 19 rises relatively due to the driving of the piezoelectric element 26, as illustrated in FIG. 4A, the edge of the opening 23 of the diaphragm 24 is elastically displaced to the reservoir 17 side, abuts the valve receiving body 32, and enters an open-valve state, thereby inhibiting the flowing out of the ink from the pressure chamber 19 side to the reservoir 17 side. Meanwhile, when the internal pressure of the pressure chamber 19 drops relatively due to the driving of the piezoelectric element 26, as illustrated in FIG. 4B, the edge of the opening 23 of the diaphragm 24 is elastically displaced to the pressure chamber 19 side, releases the abutting state between the diaphragm 24 and the valve receiving body 32 (the edge of the opening 23 is distanced from the valve receiving body 32), and enters a closed-valve state. Accordingly, the flowing of the ink from the reservoir 17 side into the pressure chamber 19 side is allowed. In other words, due to providing the valve mechanism 21, the channel resistance in relation to the ink which flows out from the pressure chamber 19 side to the reservoir 17 side is greater than the channel resistance in relation to the ink which flows from the reservoir 17 side into the pressure chamber 19 side.

Here, with regard to the dimensions of the opening 23, it is preferable to satisfy the following expression (1) when wa is the width of the valve receiving body 32 (the dimension in a direction perpendicular to the extending direction of the valve receiving body 32) and wb is the width of the opening 23 (the dimension in a direction perpendicular to the extending direction of the valve receiving body 32).

$$wa \geq wb \quad (1)$$

Accordingly, when the internal pressure of the pressure chamber 19 rises relatively, it is possible to more reliably inhibit the flowing out of the ink from the pressure chamber 19 side to the reservoir 17 side.

It is preferable to satisfy the following expression (2) when ha is the length of the valve receiving body 32 (the dimension in the extending direction of the valve receiving body 32), and hb is the length of the opening 23 (the dimension in the extending direction of the valve receiving body 32).

$$ha \geq hb \quad (2)$$

Accordingly, when the internal pressure of the pressure chamber 19 rises relatively, it is possible to more reliably inhibit the flowing out of the ink from the pressure chamber 19 side to the reservoir 17 side.

In the recording head 3 which is formed in this manner, the pressure in the pressure chamber 19 is caused to drop by driving the piezoelectric element 26, and the ink is taken into the pressure chamber 19 from the reservoir 17 via the valve mechanism 21. Subsequently, the pressure in the pressure chamber 19 is raised by driving the piezoelectric element 26.

Using the rise in pressure, the ink within the pressure chamber 19 is ejected from the nozzle 40 via the nozzle communication path 42.

In the recording head 3 in the invention, since the valve mechanism 21 is provided between the reservoir 17 and the pressure chamber 19, it is possible to suppress the counterflow of the ink to the reservoir 17 side when the pressure in the pressure chamber 19 is raised. Accordingly, it is possible to efficiently transmit the rise in pressure in the pressure chamber 19 to the nozzle 40 side, and it is possible to efficiently eject the ink from the nozzle 40. As a result, it is possible to reduce the pressure change which is generated by the piezoelectric element 26 which is necessary to eject a fixed amount of the ink. Accordingly, it is possible to reduce the size of the piezoelectric element 26 (the active portion), and thus it is possible to reduce the size of the recording head 3. By reducing the size of the piezoelectric elements 26, it is possible to reduce the pitch at which the piezoelectric elements 26 are provided to line up. In other words, it is possible to reduce the pitch at which the nozzles 40 are provided to line up. Accordingly, since it is possible to reduce the pitch at which the nozzles are formed, higher definition printing becomes possible, and it is possible to improve the quality of the printing. It is possible to lower the voltage which is applied to the piezoelectric element 26, and the reliability of the recording head 3 is improved.

In the related art, the supply path which acts as a channel resistance and has a narrower width than the pressure chamber is formed between the reservoir and the pressure chamber; however, since it is not necessary to form such a supply path, it is possible to further reduce the size of the recording head 3. Since the pressure change which is generated in the pressure chamber 19 during the ejection of the ink does not easily transmit to the reservoir 17 side due to the valve mechanism 21, it is possible to reduce the area of the portion (the compliance portion) which is provided in the reservoir 17 and which functions as a damper which absorbs the pressure change. In other words, in the compliance portion, an area may be secured at which it is possible to suppress the pressure change within the reservoir 17 which is generated when the ink within the reservoir 17 is supplied to a range which causes no problems in the specification of the product, and it is possible to reduce the size of the compliance portion as much as possible within the range. Accordingly, it is possible to further reduce the size of the recording head 3. Since the valve mechanism 21 is formed of the opening 23 of the diaphragm 24 and the valve receiving body 32 which is provided in a position to face the opening 23 mutually in the reservoir 17 side, it is possible to simplify the configuration of the valve mechanism 21. Since the edge of the opening 23 and the valve receiving body 32 overlap each other as viewed from a center axial direction of the opening 23 of the diaphragm 24, it is possible to more reliably prevent the flowing out of the ink to the reservoir 17 side.

Next, description will be given of the manufacturing method of the recording head 3 which includes the valve mechanism 21 described above. FIGS. 5A to 8B are diagrams of a state transition in cross section which illustrate the manufacturing process of the valve mechanism 21. In the present embodiment, rises in the manufacturing cost caused by an increase in the number of processes are suppressed by sharing the majority of the processes of forming the valve mechanism 21 with the processes of forming the diaphragm, the piezoelectric element, and the common metal layer of the related art. Note that, in the following manufacturing method, description is given with the main focus on the valve mechanism 21.

Figure 5A:
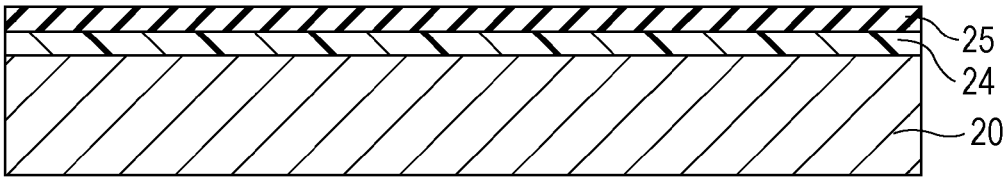
FIGS. 5A to 5C are diagrams of a state transition in cross section which illustrate the manufacturing process of the valve mechanism.
Figure 5B:
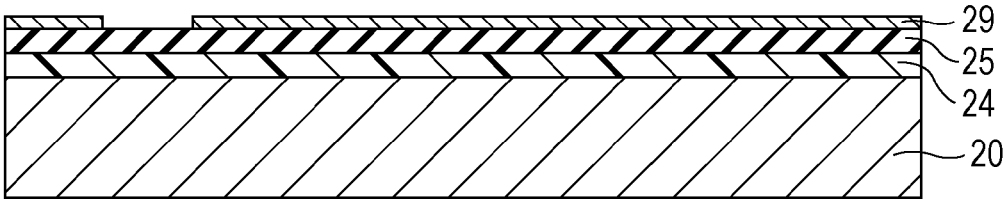
Figure 5C:
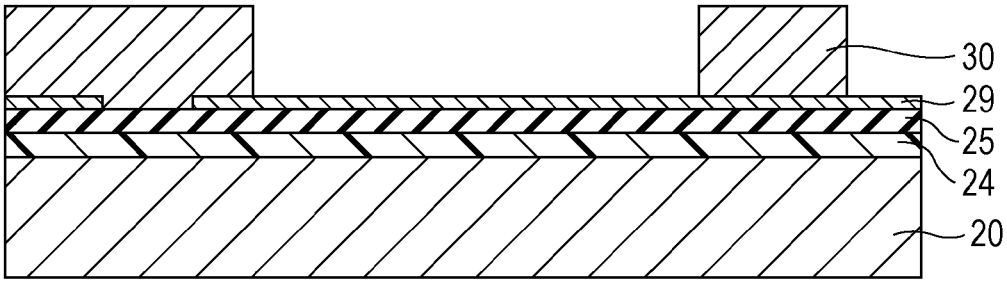
Figure 6A:
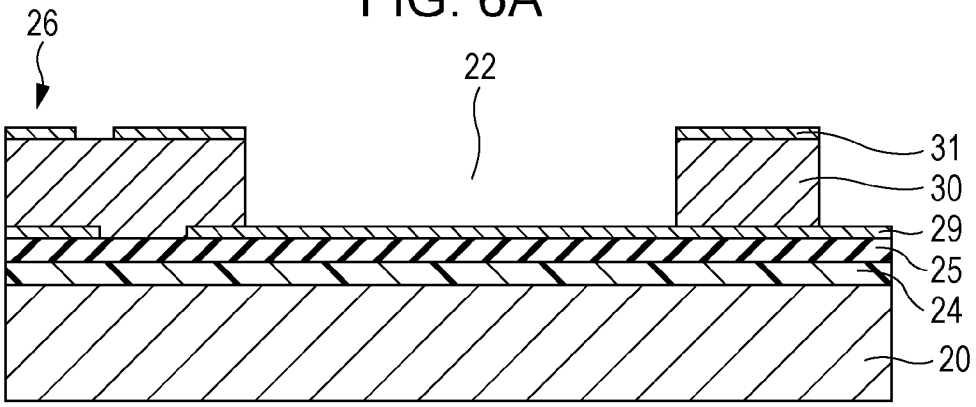
FIGS. 6A to 6C are diagrams of a state transition in cross section which illustrate the manufacturing process of the valve mechanism.

Specifically, first, as illustrated in FIG. 5A, the diaphragm 24 and the insulating film 25 are laminated, in this order, on the pressure chamber forming substrate 20 (in detail, the substrate which serves as the pressure chamber forming substrate 20, for example, a silicon single crystal substrate). As illustrated in FIG. 5B, the bottom electrode film 29 is formed as a film on the insulating film 25, and a portion which serves as the common electrode of the piezoelectric element 26 is patterned using wet etching or dry etching. Next, as illustrated in FIG. 5C, the piezoelectric layer 30 is formed as a film, a portion of the piezoelectric layer 30 is removed using wet etching or dry etching such that portions which serve as the piezoelectric elements 26 and the periphery of a portion which serves as the valve space 22 remain. Subsequently, as illustrated in FIG. 6A, the top electrode film 31 is formed as a film, a portion of the top electrode film 31 is removed using wet etching or dry etching such that portions which serve as individual electrodes of the piezoelectric elements 26 and the periphery of a portion which serves as the valve space 22 remain. Accordingly, the piezoelectric element 26 is formed.

Figure 6B:
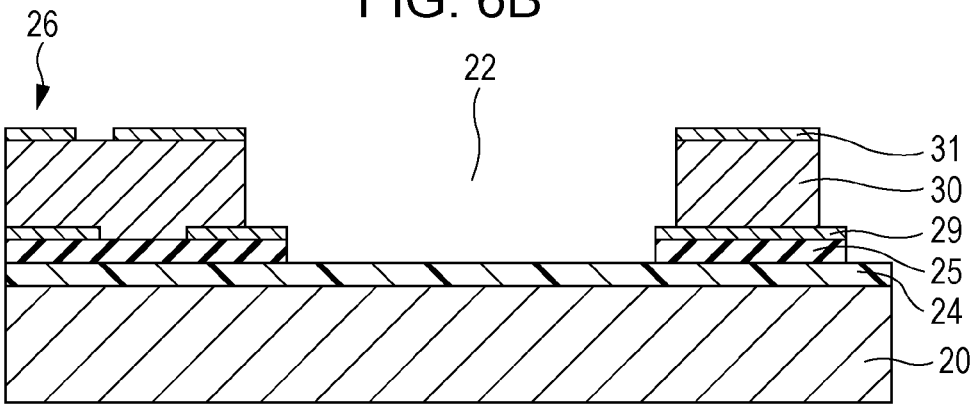
Figure 6C:
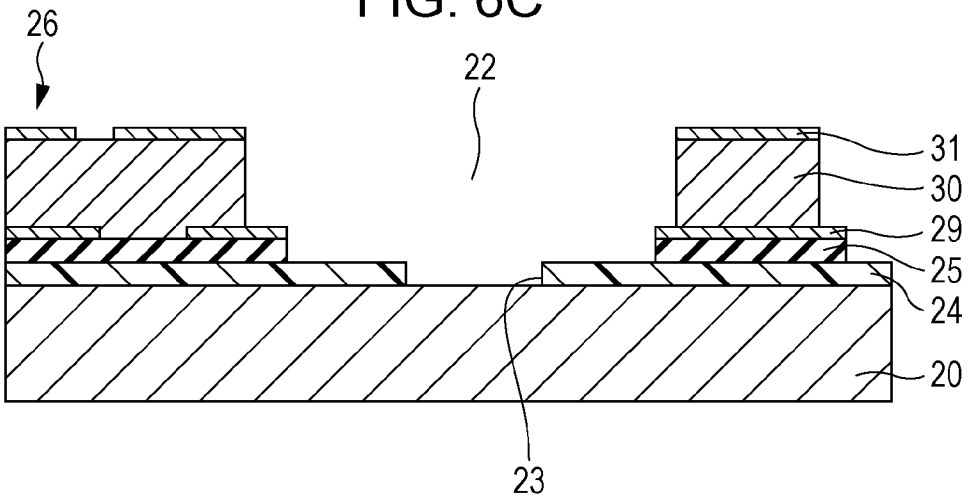
Figure 7A:
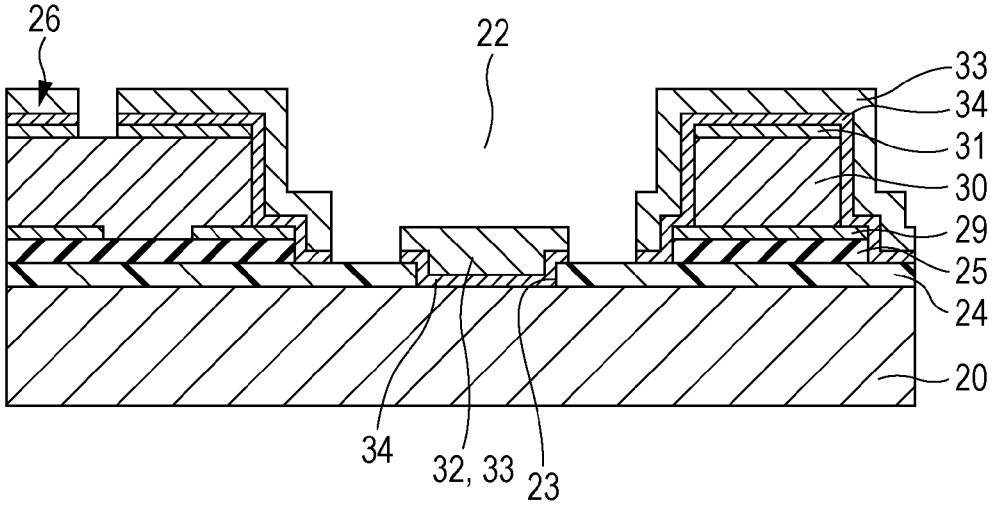
FIGS. 7A and 7B are diagrams of a state transition in cross section which illustrate the manufacturing process of the valve mechanism.
Figure 7B:
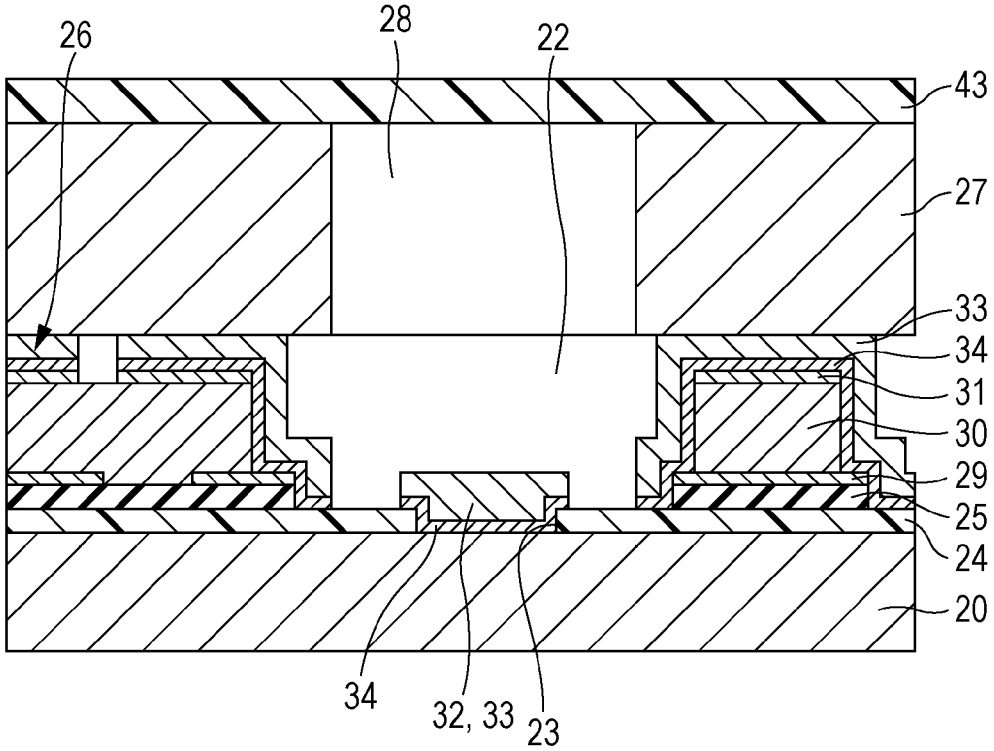

If the piezoelectric element 26 is formed, as illustrated in FIG. 6B, the insulating film 25 and the bottom electrode film 29 of a portion which serves as the valve space 22 which is formed in a region distanced from the region in which the piezoelectric element 26 is laminated are removed using wet etching or dry etching. Next, as illustrated in FIG. 6C, the opening 23 is formed by partially removing the diaphragm 24 within the valve space 22 using wet etching or dry etching and penetrating the diaphragm 24 in the thickness direction. Here, the opening 23 of the diaphragm 24 is formed smaller than the portion of the insulating film 25 and the bottom electrode film 29 within the valve space 22 which is removed. Subsequently, as illustrated in FIG. 7A, the adhesion layer 34 and the common metal layer 33 are formed as a film in this order, portions of the adhesion layer 34 and the common metal layer 33 are removed using wet etching or dry etching such that both end portions of the piezoelectric element 26 in the longitudinal direction, the periphery of the valve space 22, and the portion which serves as the valve receiving body 32 remain. Accordingly, the valve receiving body 32 is formed in a region of the diaphragm 24 which overlaps the opening 23 in the reservoir 17 side so as to interpose the adhesion layer 34. Here, the valve receiving body 32 and the adhesion layer 34 on which the valve receiving body 32 is laminated are patterned to be slightly larger than the opening 23 so as to cover the opening 23 of the diaphragm 24. Next, as illustrated in FIG. 7B, the protective substrate 27 is joined to the common metal layer 33 from the top surface side using an adhesive or the like. Accordingly, the communication path 28 of the protective substrate 27 and the valve space 22 are communicated with each other. Note that, a protective film 43 is bonded to a surface of an opposite side of the protective substrate 27 from the surface which is joined to the common metal layer 33.

Figure 8A:
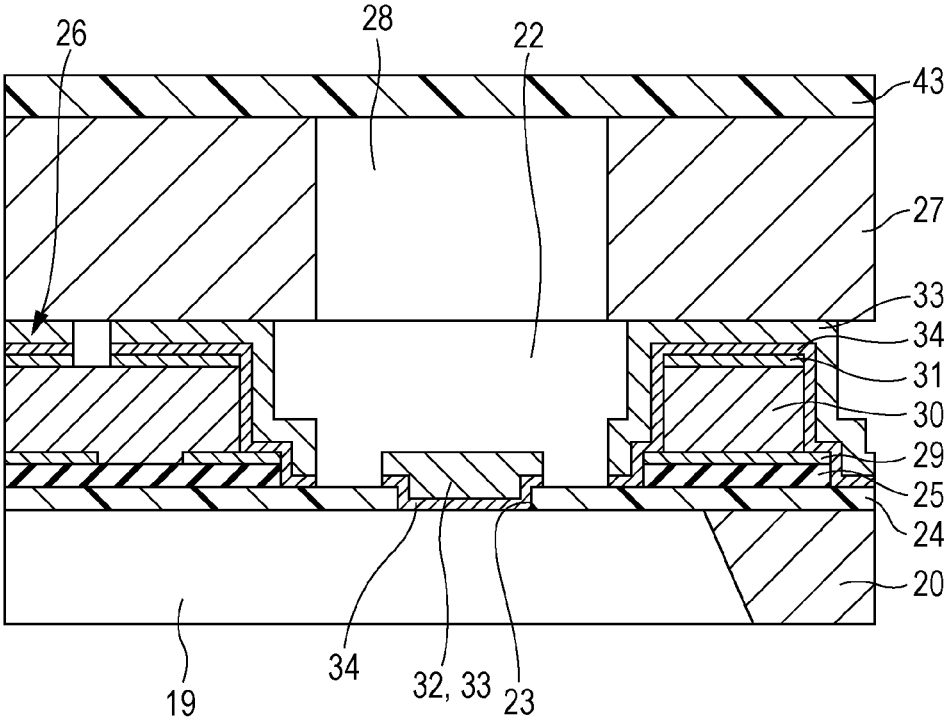
FIGS. 8A and 8B are diagrams of a state transition in cross section which illustrate the manufacturing process of the valve mechanism.
Figure 8B:
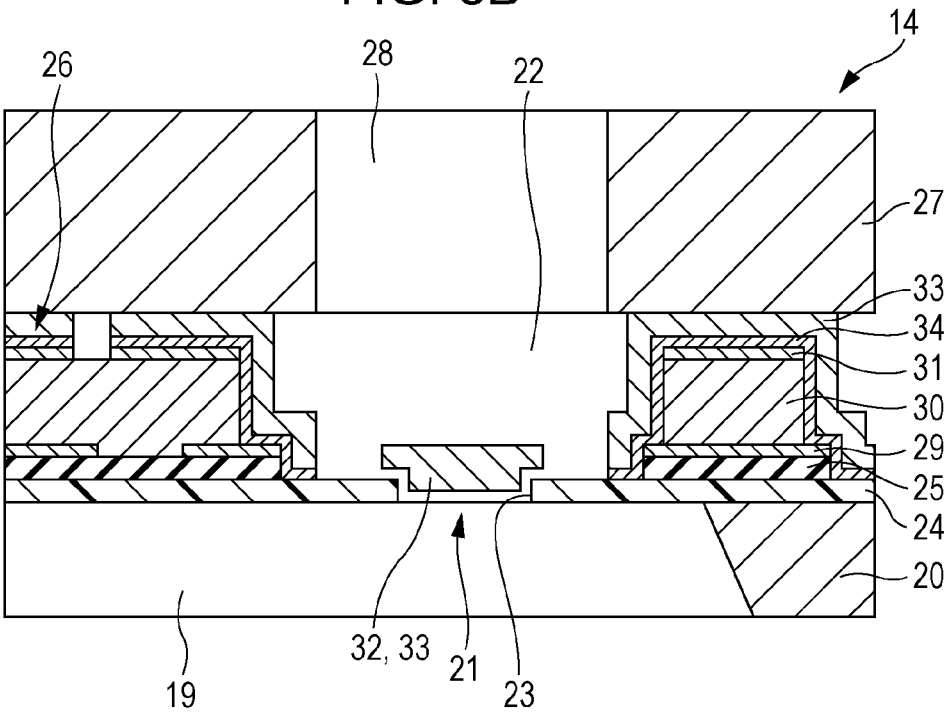

If the protective substrate 27 is joined, as illustrated in FIG. 8A, the pressure chamber 19 is formed by wet etching the substrate which serves as the pressure chamber forming substrate 20 from the surface of the opposite side from the diaphragm 24. At this time, since the protective film 43 is bonded to the protective substrate 27, the etching liquid entering the piezoelectric element 26 side from the protective substrate 27 side is suppressed. The protective film 43 is removed after the wet etching which forms the pressure chamber 19 ends. Subsequently, as illustrated in FIG. 8B, at least the adhesion layer 34 between the opening 23 and the valve receiving body 32 is removed by wet etching using an etching liquid which removes only the adhesion layer 34. Accordingly, a gap is formed between the valve receiving body 32 and the diaphragm 24. In this manner, the pressure generation unit 14 which includes the valve mechanism 21 is formed. Finally, the recording head 3 which includes the valve mechanism 21 is created by joining the channel unit 15 to the pressure generation unit 14 from the bottom surface side (the pressure chamber forming substrate 20 side), and by joining the head case 16 to the pressure generation unit 14 from the top surface side (the protective substrate 27 side).

In this manner, since the manufacturing method of the recording head 3 in the invention includes a process in which the opening 23 is formed in a region which is distanced from the region in which the piezoelectric element 26 of the diaphragm 24 is laminated, a process in which the valve receiving body 32 is formed to interpose the adhesion layer 34 in a region which overlaps the opening 23 in the reservoir 17 side of the diaphragm 24, and a process in which at least the adhesion layer 34 between the opening 23 and the valve receiving body 32 is removed, it is possible to easily form the valve mechanism 21.

Incidentally, the configuration in which the valve mechanism is provided in a region which is distanced from the region which is between the reservoir and the pressure chamber and in which the piezoelectric element of the diaphragm of the recording head is laminated is not limited to the embodiment described above. In the second embodiment illustrated in FIGS. 9A and 9B, the valve mechanism 46 is formed on the bottom side (the opposite side from a pressure chamber 19') of a communication substrate 41'.

Figure 9A:
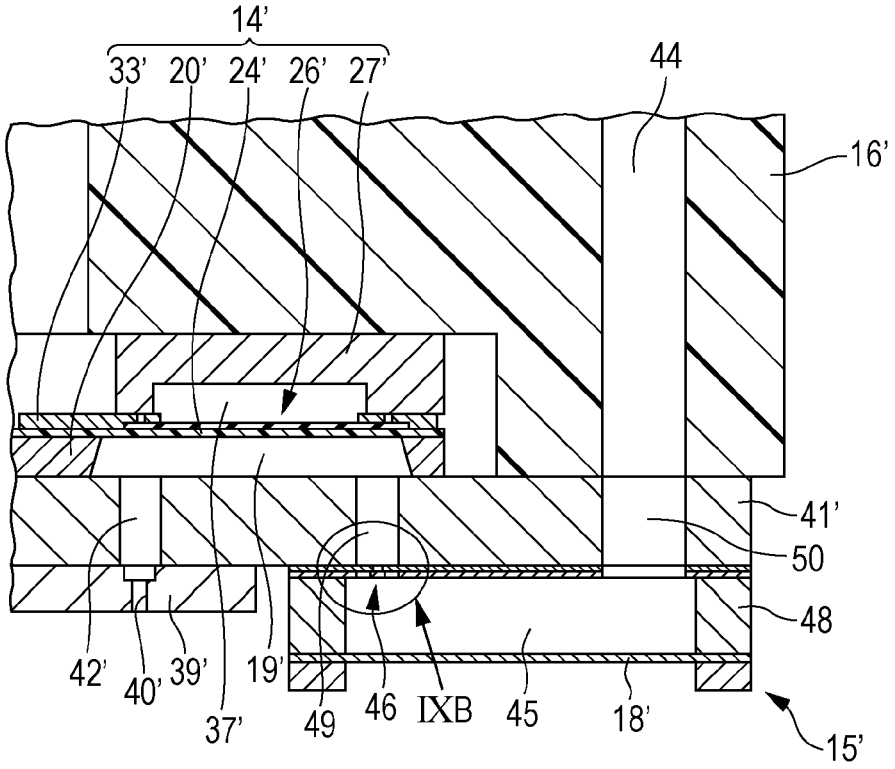
FIG. 9A is a cross sectional diagram illustrating the configuration of a recording head in a second embodiment.
Figure 9B:
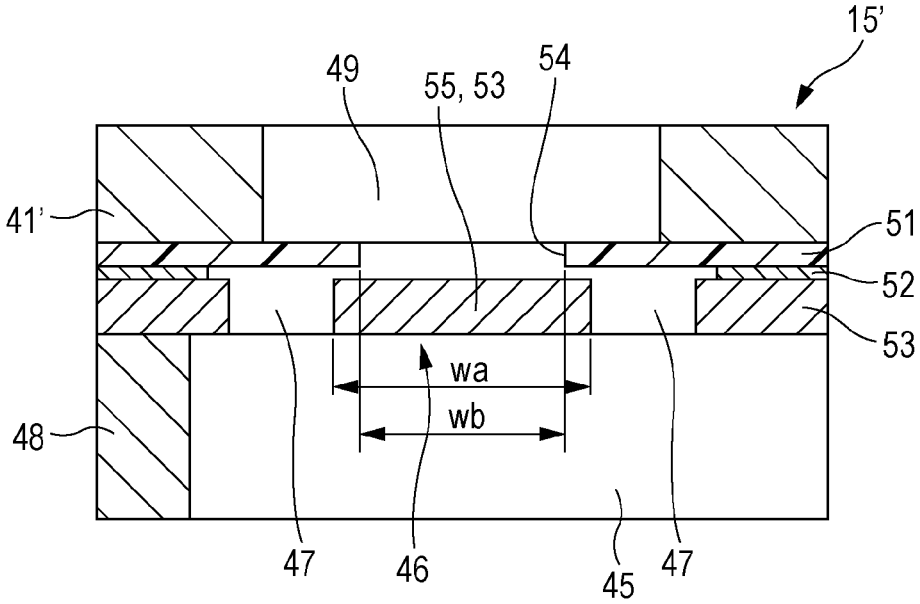
FIG. 9B is an enlarged diagram illustrating region IXB.

FIG. 9A is a cross sectional diagram illustrating the configuration of a recording head 3' in the second embodiment, and FIG. 9B is an enlarged diagram illustrating region IXB in FIG. 9A. As illustrated in FIG. 9A, the recording head 3' in the present embodiment is also provided with a pressure generation unit 14' and a channel unit 15', and is configured to be attached to a head case 16' in a state in which the members are laminated together.

As opposed to in the first embodiment described above, no reservoir is formed on the inner portion of the head case 16' of the present embodiment, and, as illustrated in FIG. 9A, a liquid supply path 44 which supplies the ink to the reservoir 45 is formed on the inner portion of the head case 16'. The ink which flows from the ink cartridges 7 into the recording head 3' flows into the reservoir 45 which is positioned below the head case 16' via the liquid supply path 44.

In the same manner as in the first embodiment described above, the pressure generation unit 14 forms a unit by a pressure chamber forming substrate 20', a diaphragm 24', a piezoelectric element 26', a protective substrate 27', and the like being laminated together; however, the valve mechanism is not provided. In other words, an opening is not provided in the diaphragm 24' which partitions the top surface of the pressure chamber forming substrate 20', and the valve space is not formed. Therefore, the opening of the top portion of the pressure chamber 19' is sealed by the diaphragm 24' without gaps. In other words, in the present embodiment, the piezoelectric element 26' is formed on the diaphragm 24' of the pressure chamber 19' via an insulating film 25', and a common metal layer 33' is formed on both end portions in the longitudinal direction on the piezoelectric element 26' via an adhesion layer (not shown). The protective substrate 27' is joined onto the common metal layer 33'.

In addition to a nozzle plate 39' and the communication substrate 41', the channel unit 15' of the present embodiment is provided with a reservoir part 48 in which the reservoir 45 is formed and the valve mechanism 46. A nozzle communication path 42' which communicates between the nozzle 40' and the pressure chamber 19' is formed in the communication substrate 41' in the same manner as in the first embodiment. Additionally, a pressure chamber communication path 49 and a reservoir communication path 50 are formed in the communication substrate 41' of the present embodiment. The pressure chamber communication path 49 is a channel which communicates between the reservoir 45 and the pressure chamber 19', and is formed between the reservoir communication path 50 and the nozzle communication path 42'. The top end of the pressure chamber communication path 49 is open to the pressure chamber 19' at the end portion of the opposite side from the nozzle communication path 42' side of the pressure chamber 19'. The bottom end of the pressure chamber communication path 49 is open to the reservoir 45 at the end portion of the opposite side from the reservoir communication path 50 side. The reservoir communication path 50 is a channel which communicates between the liquid supply path 44 and the reservoir 45, and is formed in a position corresponding to the liquid supply path 44. Note that, the nozzle plate 39' of the present embodiment is formed as small as possible, and is joined to the communication substrate 41' closer to the inside thereof than the reservoir part 48.

The reservoir part 48 is a substrate to which a compliance sheet 18' is joined from below, and is joined to the bottom surface side of the communication substrate 41' closer to the outside than the nozzle plate 39'. The reservoir 45 which supplies the ink to the plurality of pressure chambers is formed on the inner portion of the reservoir part 48. The reservoir 45 is shaped such that the top and bottom are open (that it, has a shape penetrated in the thickness direction), and is formed by the top being sealed by the communication substrate 41' (in detail, the communication substrate 41' in which an elastic substrate 51, an intermediary layer 52, and a valve receiving body forming substrate 53 (described later) are laminated on the bottom surface side of the communication substrate 41') and the bottom being sealed by the compliance sheet 18'. A portion (a compliance portion) which functions as a damper which absorbs a pressure change of the ink within the reservoir 45 is formed below the reservoir part 48 by the compliance sheet 18'. According to the present embodiment, in the same manner as the embodiment described above, it is possible to reduce the area of the portion (the compliance portion) which functions as a damper. Note that, the reservoir part 48 may be formed of a single substrate, and may be formed by laminating a plurality of substrates together. For example, when the reservoir part is formed of a plurality of substrates, it is possible to form the compliance portion in the middle of the reservoir part by inserting a compliance sheet in the middle of the plurality of substrates.

As illustrated in FIG. 9B, the elastic substrate 51, the intermediary layer 52, and the valve receiving body forming substrate 53 are laminated between the reservoir part 48 and the communication substrate 41'. Specifically, the elastic substrate 51, the intermediary layer 52, and the valve receiving body forming substrate 53 are laminated in order from the bottom surface side of the communication substrate 41'. The elastic substrate 51, the intermediary layer 52, and the valve receiving body forming substrate 53 are layers for forming the valve mechanism 46. The elastic substrate 51 is a flexible substrate (a film), and is formed of silicon dioxide which is approximately 1 μm thick, for example. The intermediary layer 52 is formed of titanium, nickel, chrome, an alloy thereof, or the like, and improves the adherence (adhesion) between the elastic substrate 51 and the valve receiving body forming substrate 53. Additionally, it is possible to use a resin, an adhesive, or the like as the intermediary layer 52. The valve receiving body forming substrate 53 is formed of a metal such as gold (Au), for example. Note that, an opening (omitted from the drawing) for communicating between the reservoir communication path 50 and the reservoir 45 is formed in a location corresponding to the reservoir communication path 50 in the elastic substrate 51, the intermediary layer 52, and the valve receiving body forming substrate 53.

As illustrated in FIG. 9B, the valve mechanism 46 is formed between the pressure chamber communication path 49 and the reservoir 45. Specifically, the valve mechanism 46 includes an opening 54 and a valve receiving body 55. The opening 54 is formed in the elastic substrate 51 and communicates the pressure chamber 19' (the pressure chamber communication path 49) with the reservoir 45, and the valve receiving body 55 is provided in a position to mutually face the opening 54 in the reservoir 45 side and is formed of the valve receiving body forming substrate 53. The valve receiving body 55 is provided within a valve space 47 which is formed by removing the valve receiving body forming substrate 53 of a region corresponding to the pressure chamber communication path 49. In other words, the valve receiving body 55 is formed by penetrating a portion of a region corresponding to the pressure chamber communication path 49 of the valve receiving body forming substrate 53 other than the portion corresponding to the opening 54 of the elastic substrate 51 in the plate thickness direction. In the same manner as in the first embodiment described above, the valve receiving body 55 of the present embodiment is formed in the center of the valve space 47 to extend in the nozzle row direction. The opening 54 of the elastic substrate 51 is formed a size smaller than the valve receiving body 55. In other words, in plan view (as viewed from a center axial direction of the opening 54 of the elastic substrate 51), the edge of the opening 54 of the elastic substrate 51 is formed to overlap the valve receiving body 55. Note that, the valve receiving body 55 and the elastic substrate 51 are distanced by leaving a gap equal to the thickness of the intermediary layer 52 in a state in which the elastic substrate 51 is not displaced (a non-flexing state). Note that, since the other configuration is the same as that of the first embodiment described above, description thereof will be omitted.

Figure 10A:
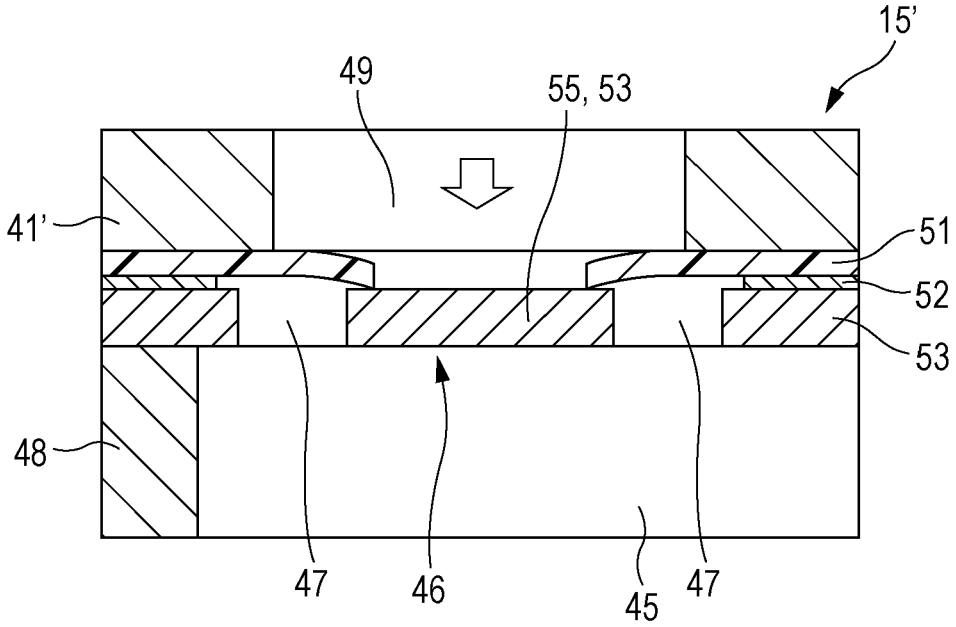
FIGS. 10A and 10B are schematic diagrams illustrating the operations of a valve mechanism in the second embodiment.
Figure 10B:
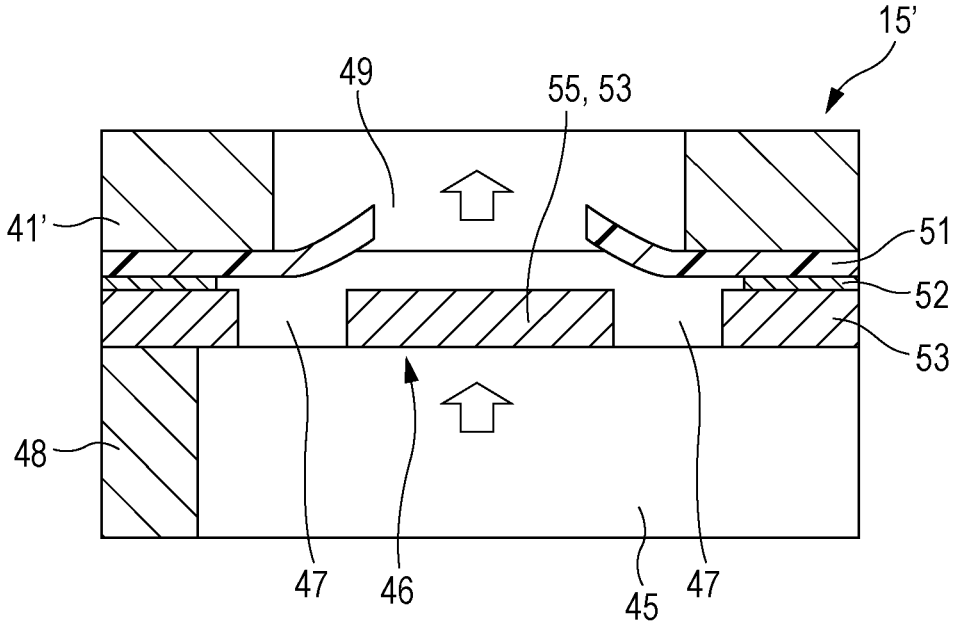

Even with the valve mechanism 46 of the present embodiment, it is possible to allow the ink to flow from the reservoir 45 side into the pressure chamber 19' side while inhibiting the ink from flowing out from the pressure chamber 19' side to the reservoir 45 side. In other words, when the internal pressure of the pressure chamber 19' rises relatively due to the driving of the piezoelectric element 26', as illustrated in FIG. 10A, the edge of the opening 54 of the elastic substrate 51 is elastically displaced to the reservoir 45 side, abuts the valve receiving body 55, and enters a closed-valve state, thereby inhibiting the flowing out of the ink from the pressure chamber 19' side to the reservoir 45 side. Meanwhile, when the internal pressure of the pressure chamber 19' drops relatively due to the driving of the piezoelectric element 26', as illustrated in FIG. 10B, the edge of the opening 54 of the elastic substrate 51 is elastically displaced to the pressure chamber 19' side, valve opens to release the space between the elastic substrate 51 and the valve receiving body 55, and allows the flowing of the ink from the reservoir 45 side into the pressure chamber 19' side. In other words, due to providing the valve mechanism 46, the channel resistance in relation to the ink which flows out from the pressure chamber 19' side to the reservoir 45 side is greater than the channel resistance in relation to the ink which flows from the reservoir 45 side into the pressure chamber 19' side.

Note that, even in the present embodiment, it is preferable to satisfy the following expression (1) when wa is the width of the valve receiving body 55 (the dimension in a direction perpendicular to the extending direction of the valve receiving body 55) and wb is the width of the opening 54 (the dimension in a direction perpendicular to the extending direction of the valve receiving body 55).

$$wa \geq wb \quad (1)$$

Accordingly, when the internal pressure of the pressure chamber 19' rises relatively, it is possible to more reliably inhibit the flowing out of the ink from the pressure chamber 19' side to the reservoir 45 side.

It is preferable to satisfy the following expression (2) when ha is the length of the valve receiving body 55 (the dimension in the extending direction of the valve receiving body 55), and hb is the length of the opening 54 (the dimension in the extending direction of the valve receiving body 55).

$$ha \geq hb \quad (2)$$

Accordingly, when the internal pressure of the pressure chamber 19' rises relatively, it is possible to more reliably inhibit the flowing out of the ink from the pressure chamber 19' side to the reservoir 45 side.

In the recording head 3' of the present embodiment, since the valve mechanism 46 is provided between the reservoir 45 and the pressure chamber 19', it is possible to suppress the counterflow of the ink to the reservoir 45 side when the pressure in the pressure chamber 19' is raised. Accordingly, it is possible to efficiently transmit the rise in pressure in the pressure chamber 19' to the nozzle 40 side, and it is possible to efficiently eject the ink from the nozzle 40. As a result, it is possible to reduce the pressure change which is generated by the piezoelectric element 26' which is necessary to eject a fixed amount of the ink. Accordingly, it is possible to reduce the size of the piezoelectric element 26' (the active portion), and thus it is possible to reduce the size of the recording head 3'. By reducing the size of the piezoelectric elements 26', it is possible to reduce the pitch at which the piezoelectric elements 26' are provided to line up. In other words, it is possible to reduce the pitch at which the nozzles 40' are provided to line up. Accordingly, higher definition printing becomes possible, and it is possible to improve the quality of the printing. It is possible to lower the voltage which is applied to the piezoelectric element 26', and the reliability of the recording head 3' is improved.

Even in the present embodiment, since it is not necessary to form the supply path between the reservoir and the pressure chamber as in the related art, it is possible to further reduce the size of the recording head 3'. Since the pressure change which is generated in the pressure chamber 19' during the ejection of the ink does not easily transmit to the reservoir 45 side due to the valve mechanism 46, it is possible to reduce the area of the portion (the compliance portion) which is provided in the reservoir 45 and which functions as a damper which absorbs the pressure change. Accordingly, it is possible to further reduce the size of the recording head 3'. Since the valve mechanism 46 is formed of the opening 54 of the elastic substrate 51 and the valve receiving body 55 which is provided in a position to face the opening 54 mutually in the reservoir 45 side, it is possible to simplify the configuration of the valve mechanism 46. Since the edge of the opening 54 and the valve receiving body 55 overlap each other as viewed from a center axial direction of the opening 54 of the elastic substrate 51, it is possible to more reliably prevent the flowing out of the ink to the reservoir 45 side.

Figure 11A:
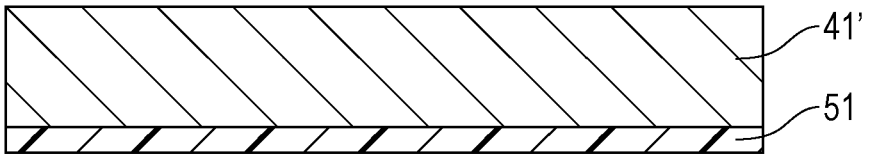
FIGS. 11A to 11C are diagrams of a state transition in cross section which illustrate the manufacturing process of the valve mechanism in the second embodiment.
Figure 13A:
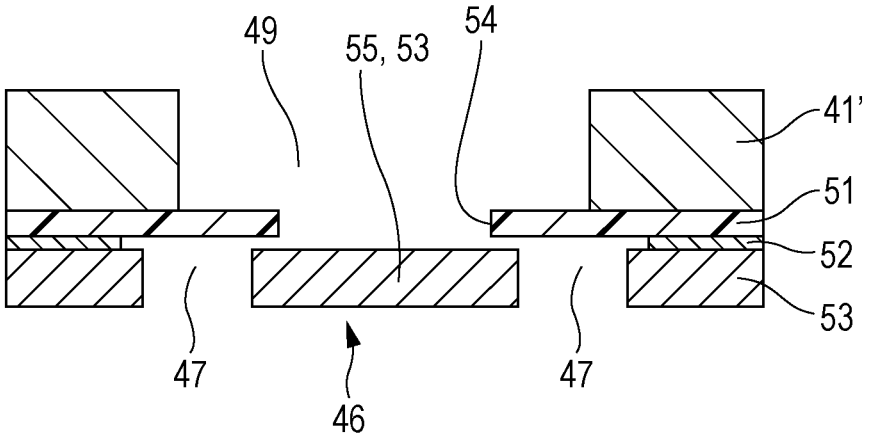
FIGS. 13A and 13B are diagrams of a state transition in cross section which illustrate the manufacturing process of the valve mechanism in the second embodiment.
Figure 13B:
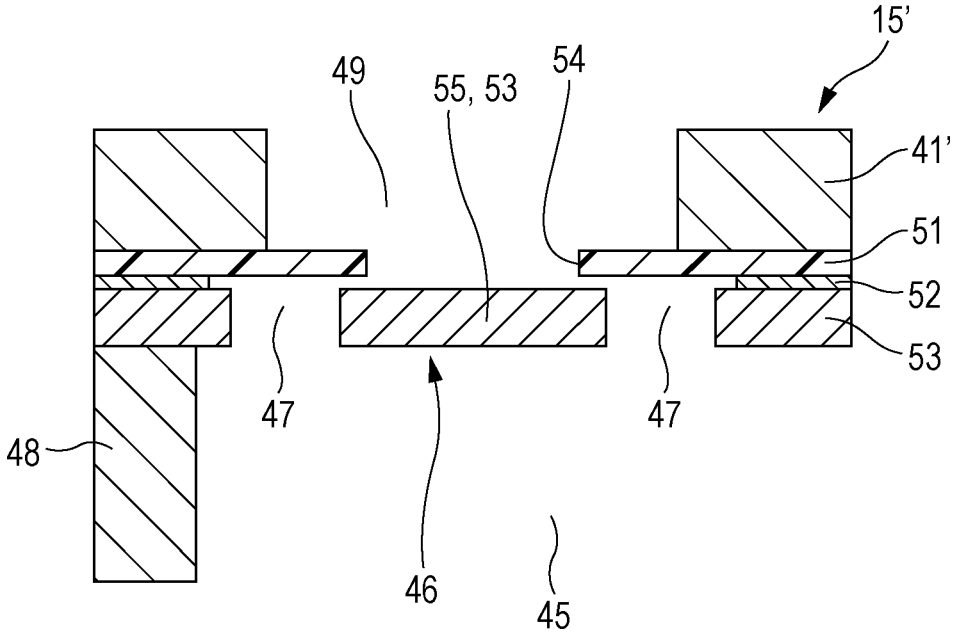

Next, description will be given of the manufacturing method of the recording head 3' which includes the valve mechanism 46 of the present embodiment. FIGS. 11A and 13B are diagrams of a state transition in cross section which illustrate the manufacturing process of the valve mechanism 46 in the present embodiment. Note that, in the following manufacturing method, description is given with a main focus on the valve mechanism 46.

Figure 11B:
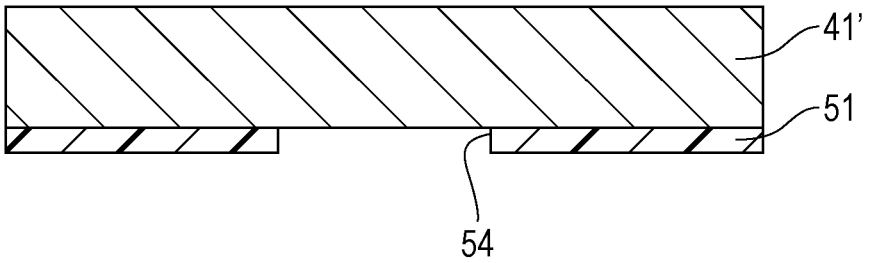
Figure 11C:
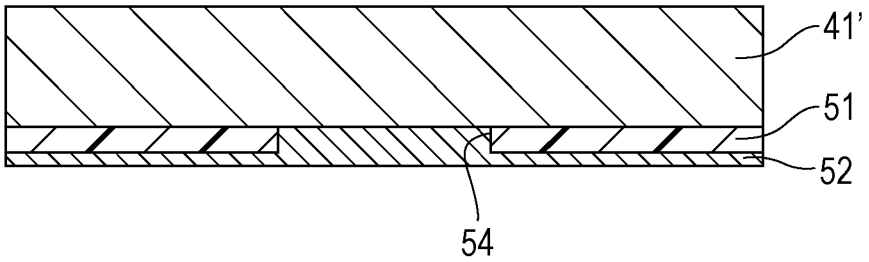
Figure 12A:
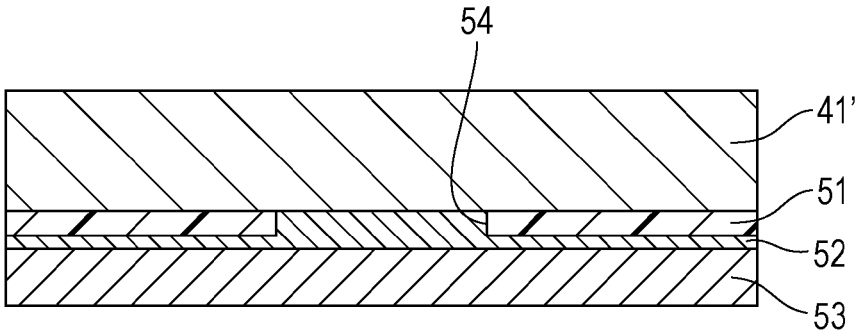
FIGS. 12A to 12C are diagrams of a state transition in cross section which illustrate the manufacturing process of the valve mechanism in the second embodiment.

As illustrated in FIG. 11A, the elastic substrate 51 is formed as a film on the bottom surface of the communication substrate 41' (in detail, the substrate which serves as the communication substrate 41', for example, a silicon single crystal substrate). Next, as illustrated in FIG. 11B, the opening 54 is formed by removing a portion of the elastic substrate 51 using wet etching or dry etching. As illustrated in FIG. 11C, the intermediary layer 52 is formed as a film on the bottom surface side of the communication substrate 41' on which the elastic substrate 51 is laminated. As illustrated in FIG. 12A, the valve receiving body forming substrate 53 is formed as a film on the bottom surface side of the intermediary layer 52.

Figure 12B:
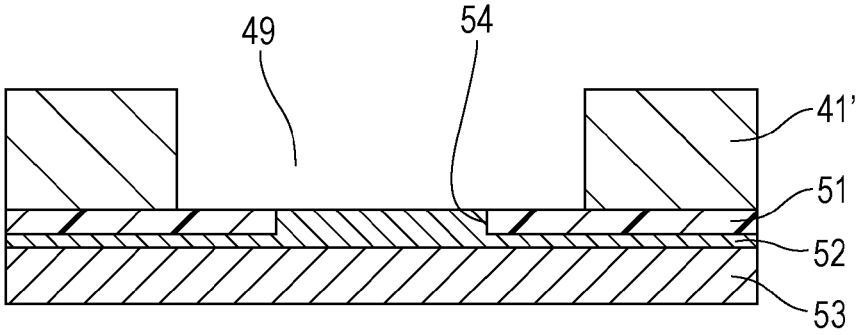
Figure 12C:
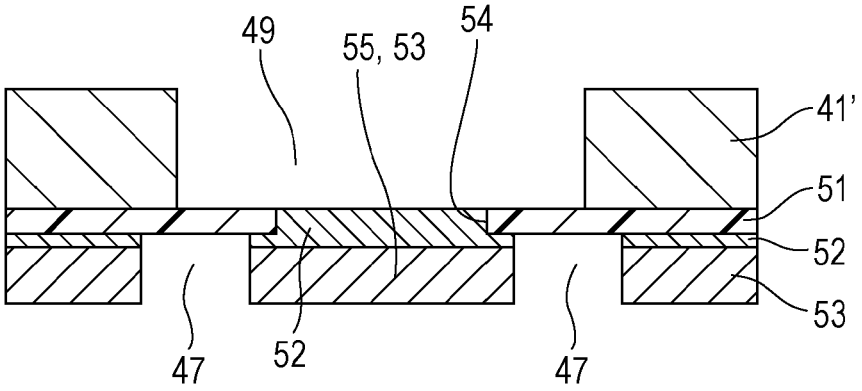

If the valve receiving body forming substrate 53 is laminated on the communication substrate 41' via the intermediary layer 52, the communication substrate 41' is etched using the BOSCH method or the like, and, as illustrated in FIG. 12B, the pressure chamber communication path 49 is formed. Note that, at this time, the nozzle communication path 42', the reservoir communication path 50, and the like are also formed at the same time. As illustrated in FIG. 12C, the valve receiving body 55 and the valve space 47 are formed by removing a portion of the valve receiving body forming substrate 53 and the intermediary layer 52 from the bottom surface side using wet etching or dry etching. Subsequently, as illustrated in FIG. 13A, at least the intermediary layer 52 between the opening 54 and the valve receiving body 55 is removed by wet etching using an etching liquid which removes only the intermediary layer 52. Accordingly, the valve receiving body 55 is separated from the elastic substrate 51. In this manner, the valve mechanism 46 is formed. As illustrated in FIG. 13B, if the valve mechanism 46 is formed, the reservoir part 48 is joined to the valve receiving body forming substrate 53 from the bottom surface side. The nozzle plate 39' is joined to the communication substrate 41' from the bottom surface side, and the channel unit 15' is created. Finally, the recording head 3' which includes the valve mechanism 46 is created by joining the pressure generation unit 14' and the head case 16' to the channel unit 15' from the top surface side.

Note that, in the second embodiment described above, the communication substrate is formed using a single substrate; however, it is also possible to form the communication substrate using a plurality of substrates. When the communication substrate is formed using a plurality of substrates, the valve mechanism may be formed on the bottom surface of the communication substrate, and may be formed in the middle of the communication substrate (that is, the pressure chamber communication path) in the plate thickness direction. When the valve mechanism is formed in the middle of the pressure chamber communication path in the plate thickness direction, the elastic substrate, the intermediary layer, and the valve receiving body forming substrate are laminated between vertically adjacent substrates of the plurality of substrates which form the communication substrate.

In the first and second embodiments, in a state in which the diaphragm or the elastic substrate are not displaced, the diaphragm or the elastic substrate of the edge of the opening is distanced from the valve receiving body; however, the invention is not limited thereto, and it is also possible to configure the diaphragm or the elastic substrate not to be distanced. That is, when the internal pressure of the pressure chamber drops relatively, the diaphragm or the elastic substrate of the edge of the opening may be displaced to the pressure chamber side, and may permit the flowing in of the ink from the reservoir side to the pressure chamber side.

In the first and second embodiments described above, the manufacturing process of the valve mechanism is described as the manufacturing method of the recording head; however, the invention is not limited thereto. In the manufacturing method described above, it is possible to use the manufacturing process of the valve mechanism as the manufacturing method of the valve mechanism. For example, it is possible to adapt the manufacturing process of the valve mechanism for the manufacturing method of a valve mechanism which is provided in something other than the recording head described above.

Figure 14:
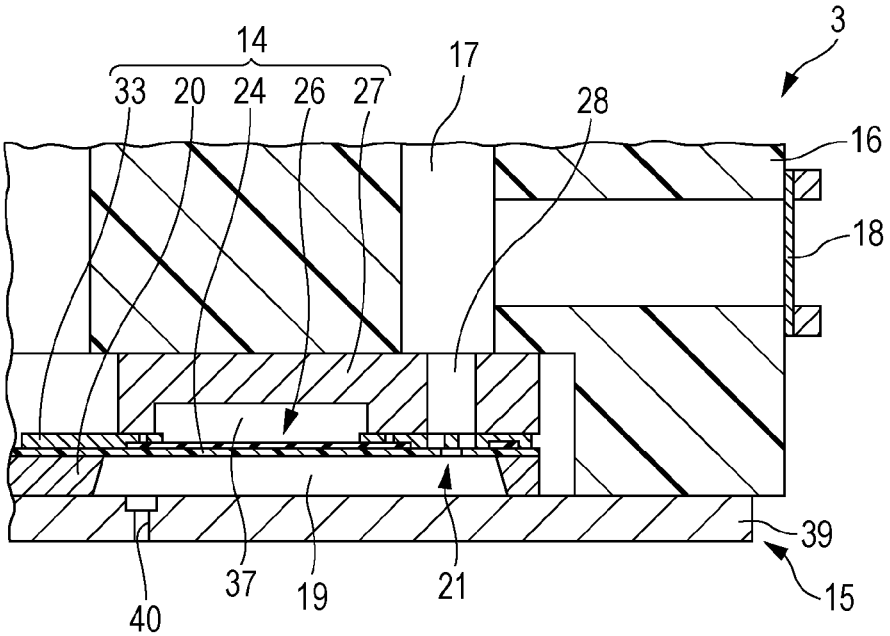
FIG. 14 is a cross sectional diagram illustrating the configuration of a recording head in a third embodiment.

Incidentally, in the first embodiment described above, the communication substrate 41 is laminated between the pressure chamber forming substrate 20 and the nozzle plate 39; however, the invention is not limited thereto. In the third embodiment illustrated in FIG. 14, the communication substrate is not provided, and the nozzle plate 39 is joined to the pressure chamber forming substrate 20. In other words, the opening of the bottom portion of the pressure chamber 19 is sealed by the nozzle plate 39. The nozzle 40 communicates directly with the end portion of the opposite side from the valve mechanism 21 side of the pressure chamber 19 in the longitudinal direction of the pressure chamber 19. The head case 16 is joined to the nozzle plate 39 further outside than the pressure generation unit 14 of the top surface of the nozzle plate 39. Note that, since the other configuration is the same as that of the first embodiment described above, description thereof will be omitted.

In this manner, since the communication substrate is not provided in the present embodiment, the number of manufacturing processes of the recording head 3 is reduced. Accordingly, it is possible to reduce manufacturing costs. It is possible to reduce the thickness of the recording head 3 by an amount equal to the thickness of the communication substrate, and it is possible to further reduce the size of the recording head 3.

Figure 15:
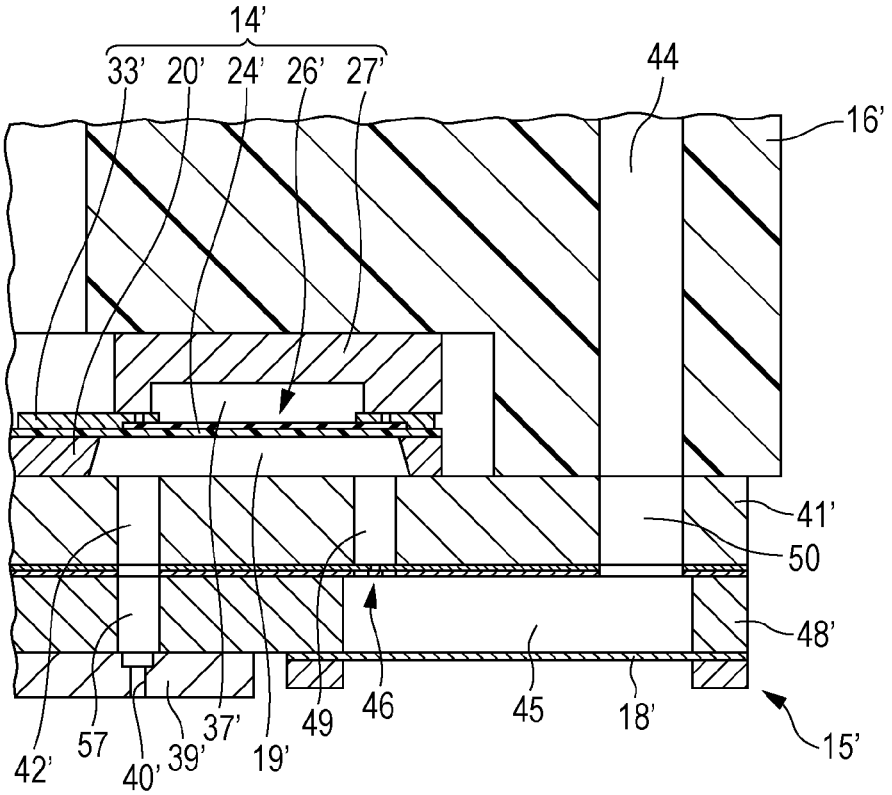
FIG. 15 is a cross sectional diagram illustrating the configuration of a recording head in a fourth embodiment.

In the second embodiment described above, the nozzle plate 39' is joined to the bottom surface of the communication substrate 41' closer to the inside than the reservoir part 48; however, the invention is not limited thereto. In the fourth embodiment illustrated in FIG. 15, the nozzle plate 39' is joined to the bottom surface of the reservoir part 48. Specifically, the reservoir part 48 extends further inside than a position corresponding to the nozzle communication path 42', and the nozzle plate 39' is joined to the portion of the inside of the reservoir part 48. Note that, together with the reservoir part 48, the elastic substrate 51, the intermediary layer 52, and the valve receiving body forming substrate 53 extend further inward than a position corresponding to the nozzle communication path 42'. The compliance sheet 18' is provided on the outside of the nozzle plate in a region corresponding to the reservoir 45. Note that, it is possible to adopt a configuration in which the compliance sheet 18' extends further inward than a position corresponding to the nozzle communication path, in the same manner as the reservoir part 48. A through hole 57 which communicates the nozzle communication path 42' with the nozzle 40' is formed in a position corresponding to the nozzle communication path 42' of the reservoir part 48, and openings (omitted from the drawings) are also formed in the same position in the elastic substrate 51, the intermediary layer 52, and the valve receiving body forming substrate 53. Note that, since the other configuration is the same as that of the second embodiment described above, description thereof will be omitted.

In this manner, since the nozzle plate 39' is formed below the reservoir part 48, for example, when the bottom surface of the nozzle plate 39' is wiped by a wiper (not shown), it is possible to suppress the occurrence of a problem in which the wiper is inhibited from abutting the nozzle plate 39' by the reservoir part 48. Accordingly, it is possible to more reliably wipe the bottom surface of the nozzle plate 39' with the wiper.

In the embodiments described above, an ink jet recording head which is mounted to an ink jet printer is exemplified; however, as long as the piezoelectric element and the pressure chamber of the configurations described above are present, it is possible to apply the invention to an apparatus which ejects a liquid other than ink. For example, it is possible to apply the invention to a color material ejecting head which is used in the manufacture of a color filter of a liquid crystal display or the like, an electrode material ejecting head which is used in forming electrodes of an organic electro luminescence (EL) display, a face emission display (FED), and the like, a bio-organic matter ejecting head used in the manufacture of bio chips (biochemical elements), and the like.

What is claimed is:

1. A liquid ejecting head, comprising:

a nozzle which ejects a liquid;

a pressure chamber, a portion of which is partitioned by a flexible diaphragm and which communicates with the nozzle;

an actuator which is laminated on the flexible diaphragm and changes a pressure within the pressure chamber; and a reservoir which communicates with the pressure chamber, wherein a valve mechanism is provided in a region which is distanced from a region in which the actuator of the diaphragm is laminated, and is configured to allow the liquid to flow from the reservoir side into the pressure chamber side while inhibiting the liquid from flowing out from the pressure chamber side to the reservoir side, wherein the valve mechanism is laminated over a surface of a pressure chamber forming substrate forming the pressure chamber.

2. The liquid ejecting head according to claim 1, wherein the valve mechanism includes an opening which communicates the reservoir with the pressure chamber, and a valve receiving body which is provided in a position to mutually face the opening in the reservoir side, and wherein, when an internal pressure of the pressure chamber rises relatively, an edge of the opening is elastically displaced to the reservoir side and inhibits the liquid from flowing out.

3. The liquid ejecting head according to claim 2, wherein the edge of the opening and the valve receiving body overlap each other as viewed from a center axial direction of the opening of the diaphragm.

4. The liquid ejecting head according to claim 1, wherein at least a portion of the reservoir is partitioned by a portion which functions as a damper which absorbs a pressure change of the liquid within the reservoir.

5. A manufacturing method of a liquid ejecting head which includes a nozzle which ejects a liquid, a pressure chamber, a portion of which is partitioned by a flexible diaphragm and which communicates with the nozzle, an actuator which is laminated on an opposite side of the diaphragm from the pressure chamber and changes a pressure within the pressure chamber, a reservoir which communicates with the pressure chamber, and a valve mechanism which is provided in a region which is distanced from a region in which the actuator of the diaphragm is laminated, the method comprising:

forming an opening in a region which is distanced from a region of the diaphragm in which the actuator is laminated;

forming a valve receiving body in a region which overlaps the opening of the diaphragm in the reservoir side to interpose a thin film therebetween; and removing at least the thin film between the opening and the valve receiving body to form the valve mechanism which is laminated over a pressure chamber forming substrate forming the pressure chamber.

* * * * *